United States Patent [19]

Okamoto

[11] Patent Number: 4,878,709

[45] Date of Patent: Nov. 7, 1989

[54] RETRACTABLE LEGREST FOR DENTAL CHAIR

[76] Inventor: Kei Okamoto, 816, Kurotani, Osawabe, Yso-Shi, Osaka, Japan

[21] Appl. No.: 148,108

[22] Filed: Jan. 27, 1988

Related U.S. Application Data

[63] Continuation of Ser. No. 70,089, Jul. 6, 1987.

[51] Int. Cl.[4] ..... A47C 7/50

[52] U.S. Cl. ..... 297/68; 297/429; 297/436

[58] Field of Search ..... 297/429, 436

[56] References Cited

U.S. PATENT DOCUMENTS

| | | | |
|---|---|---|---|
| 2,919,746 | 1/1960 | Fidel | 297/68 |
| 3,858,938 | 1/1975 | Kristensson et al. | 297/429 |
| 3,964,786 | 6/1976 | Mashuda | 297/330 |
| 4,509,795 | 4/1985 | Brennan et al. | 297/436 X |

FOREIGN PATENT DOCUMENTS

| | | | |
|---|---|---|---|
| 1099866 | 2/1961 | Fed. Rep. of Germany | 297/429 |

*Primary Examiner*—Peter A. Aschenbrenner
*Attorney, Agent, or Firm*—Stephen E. Feldman

[57] ABSTRACT

An air cylinder 8, pivotally carried at 7 proximate the front end of a dental chair, when extended moves a legrest frame 4 and an extension frame 11 to an extended position through a linkage mechanism including three pairs of linkage arms 21, 23, and 26. Each linkage arm 21 is pivotally connected to seat 1 at one end, and to a linkage arm 23 at the other. Linkage arms 23 are pivotally carried by a sub-frame 6, connected to and movable by cylinder 8, and are each pivotally connected at their other ends to linkage arm 26 pivotally carried by frame 11. The arrangement and sizing of linkage arms 21, 23 and 26 and their pivotal connection to each other and frames 6 and 11 is such that extension frame 11 when extended moves slowly at first and then more rapidly. A spring roller 16, tension belt 17 and sheet 18 cooperate with extension 11 to retract same.

6 Claims, 4 Drawing Sheets

RETRACTABLE LEGREST FOR DENTAL CHAIR

This application is a continuation, of application Ser. No. 070,089, filed July 6, 1987.

BACKGROUND OF THE INVENTION

1. Field of Application

This invention relates to legrest for positionable chairs; and more particularly to legrests for dental chairs.

2. Description of the Prior Art

Chairs, such as those used by dentists, doctors, barbers and the like, quite often are provided with legrests upon which the person seated in the chair can support their feet. Many such chairs are positionable. That is, the chair is movable between an upright position, wherein the person seated in the chair is upright; and a reclining position, wherein the person seated in the chair is substantially horizontal or lying down.

If the legrest provided for such a chair has but a single position it may not be suitable to accommodate the person so seated in the chair in both the upright and the reclining positions.

SUMMARY OF THE INVENTION

It is therefore an object of this invention to provide a new and improved legrest for a positionable chair.

It is another object of this invention to provide a new and improved legrest for a dental chair.

It is still another object of this invention to provide a new and improved extendable and retractable legrest for a dental chair.

It is yet another object of this invention to provide a new and improved linkage mechanism for an extendable and retractable legrest for a dental chair.

It is yet still another object of this invention to provide a new and improved linkage mechanism which controls the extendable and retractable legrest of a dental chair in such a way that the apex of the legrest does not touch the floor during extension of the legrest.

It is a further object of this invention to provide a new and improved cover sheet for the extendable and retractable legrest for a dental chair.

It is still a further object of this invention to provide a new and improved cover sheet for the extendable and retractable legrest for a dental chair such that the sheet is maintained under constant tension.

Other objects, features and advantages of the invention in its details of construction and arrangement of parts will be seen from the above, from the following description of the preferred embodiment when considered with the drawing and from the appended claims. In addition, these and other objects and advantages of the present invention will become evident from the description which follows.

BRIEF DESCRIPTION OF THE INVENTION

This invention involves extendable and retractable legrests for dental chairs and the like, and contemplates interconnecting the legrest to the seat of the chair through a linkage mechanism that provides a movement for the extending legrest that is initially slow and which thereafter accelerates as the legrest is fully extended. It further contemplates providing a cover device for the extendable and retractable legrest that is under constant tension in both the extended and retracted positions of the legrest.

The invention accordingly consists in the features of construction, combination of elements, and arrangement of parts which will be exemplified in the system, device, and article of manufacture hereinafter described, and of which the scope of application is as elucidated supra and as will be indicated in the appended claims. In this regard, numerous alternatives within the scope of the present invention, besides those alternatives, preferred embodiments or modes of practicing the invention supra, and those to be elucidated, infra, will occur to those skilled in the art.

DESCRIPTION OF THE PREFERRED EMBODIMENT

Figure 1:
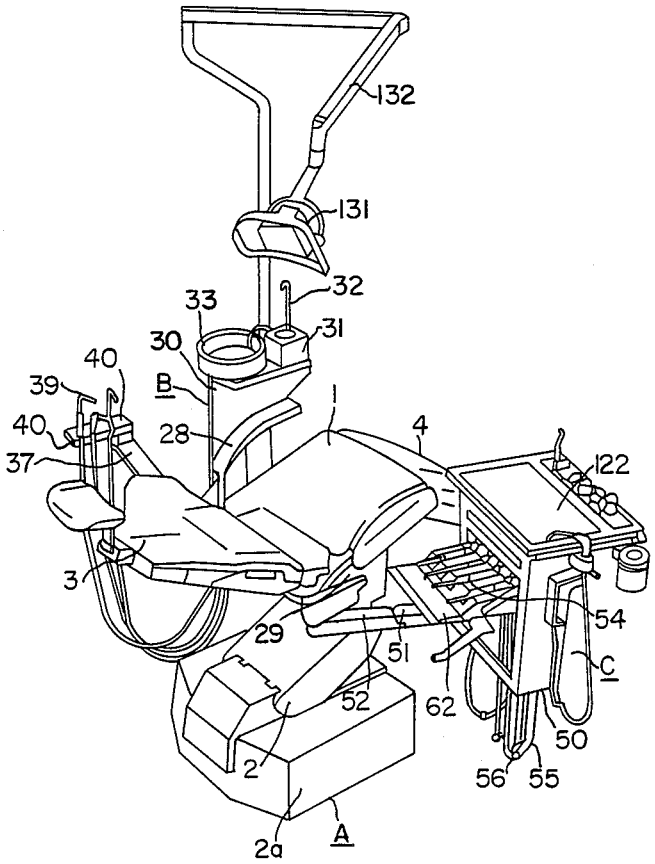
FIG. 1 is a perspective schematic showing of a dental chair incorporating the instant invention.

With reference to FIG. 1, there is generally shown a dental chair which is provided with a seat and seat plate 1 (FIGS. 1–3) appropriately and conventionally attached by a cantilever linkage mechanism 2, of conventional construction, to a base 2*a*. Seat plate 1 is attached to base 2*a* so as to permit and facilitate movement of seat plate 1 between an upright seated position for a person seated in the dental chair and a reclining position for the person in the dental chair.

A backrest 3 is attached to seat plate 1 by appropriate conventional means which facilitates a suitable movement and positioning of backrest 3 when the dental chair moves between its upright and reclined positions.

Figure 4:
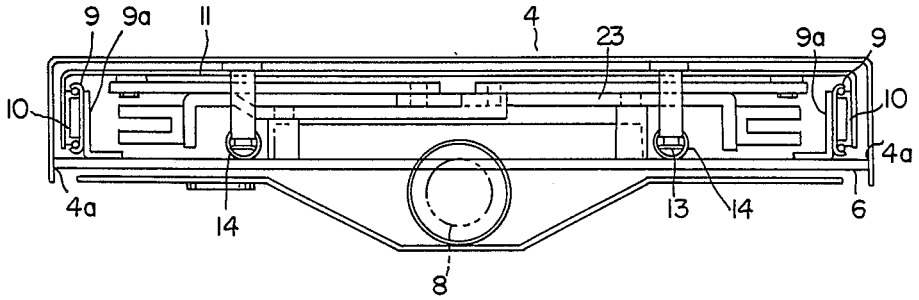
FIG. 4 is a top view of the legrest of FIGS. 2 and 3 with the seat and seat plate removed to better show details of the linkage mechanism.
Figure 2:
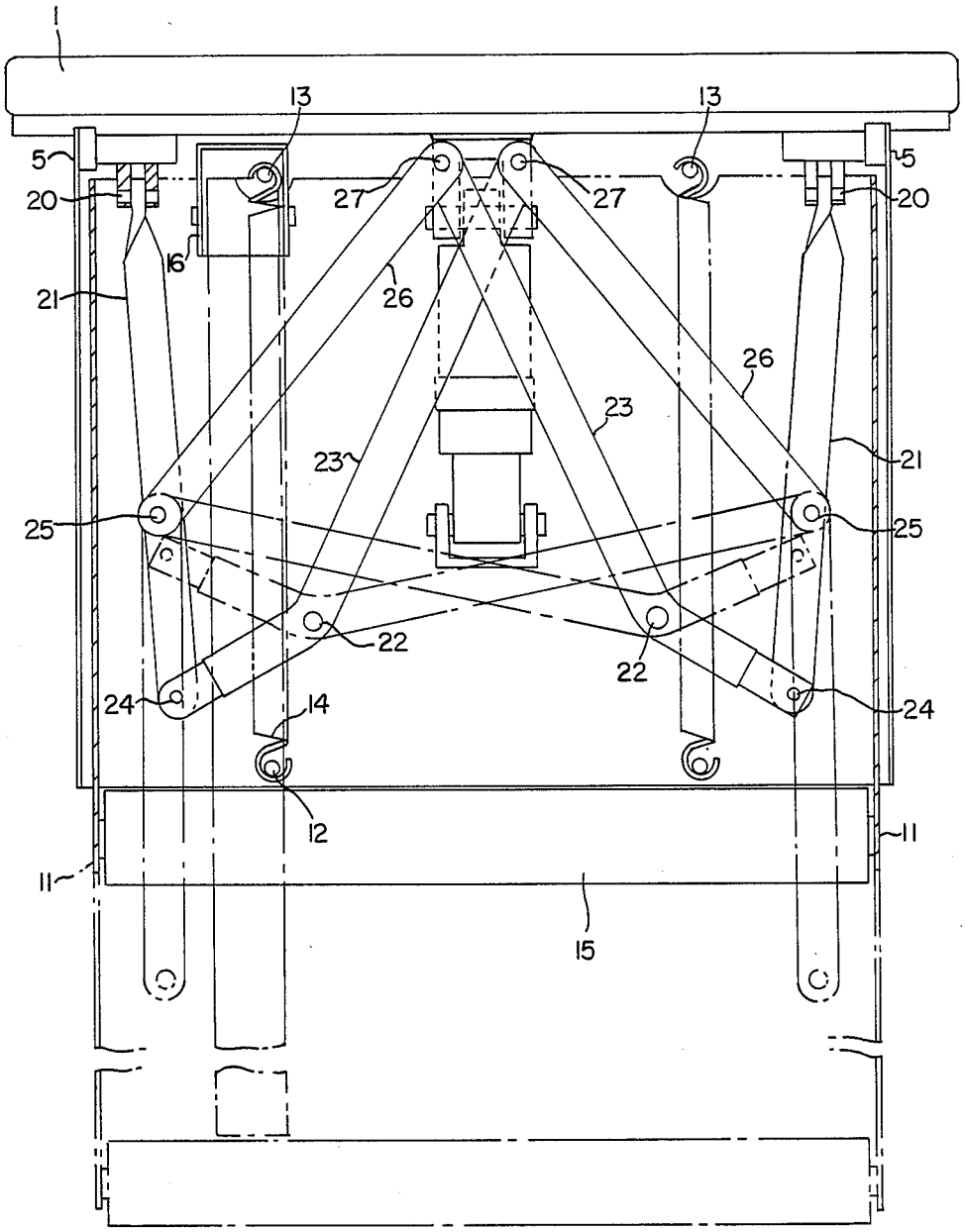
FIG. 2 is a front elevational view of the legrest portion of FIG. 1 enlarged to better show the details thereof.
Figure 3:
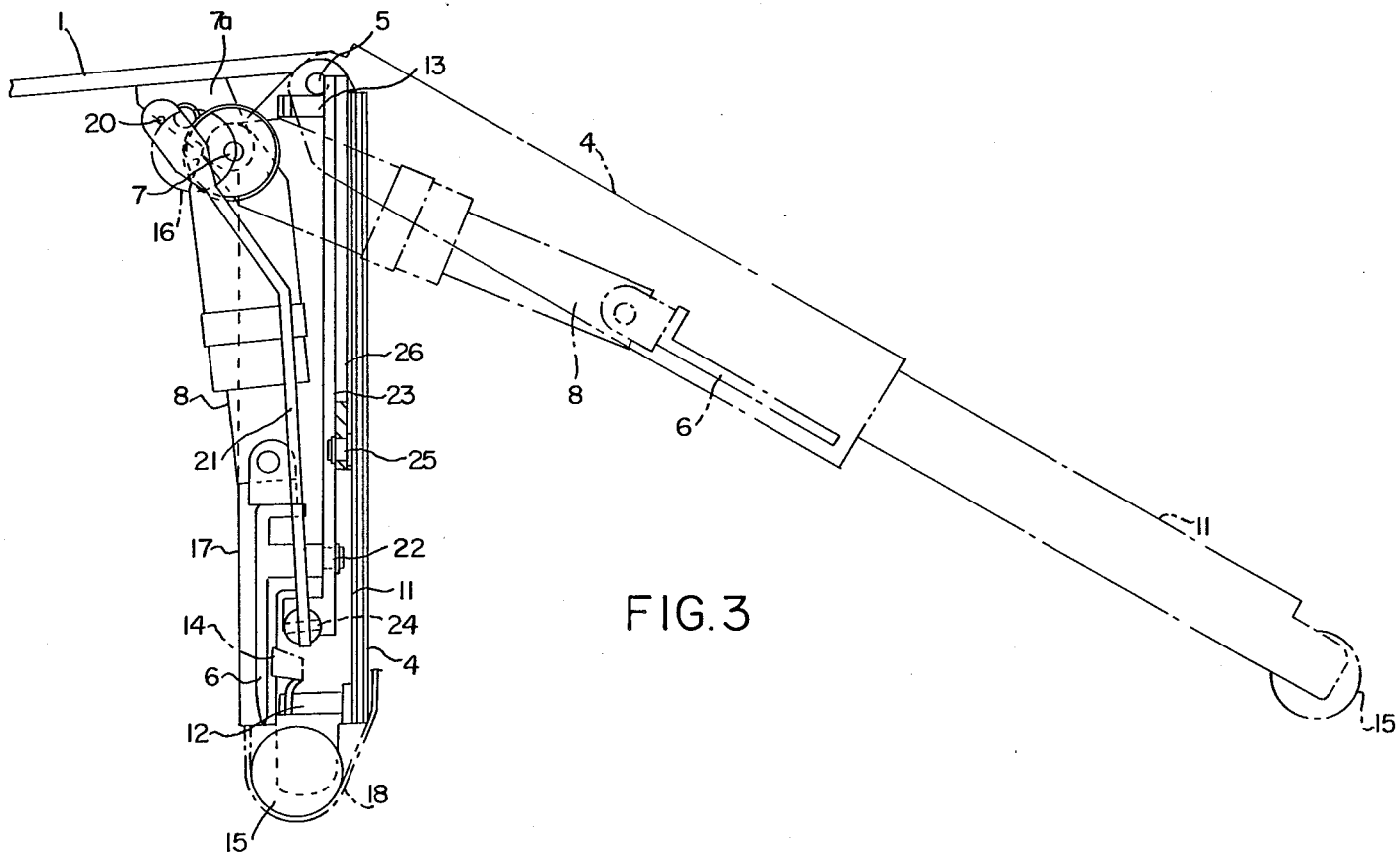
FIG. 3 is a side elevational view of the legrest of FIG. 2.

A legrest frame 4 is pivotally attached proximate the front of seat plate 1 by a legrest pivot means 5 (FIGS. 2 and 3). Connected to the legrest frame 4 at 4*a* (FIG. 4) is a sub-frame 6. Sub-frame 6 is coupled to the forward end of a compressed air cylinder 8; at 6*b* (FIG. 3), the other end of the air cylinder is attached by a pivot 7 via mounting to 7*a* the under side of seat plate 1 and further removed from the front of the seat plate 1 than the pivot means 5. Suitable and conventional means (not shown) are provided to connect cylinder 8 to a suitable and appropriate source of compressed air and to control the operation thereof for purposes to be hereinafter described. When air cylinder 8 is expanded the ram portion of air cylinder 8 thrusts sub-frame 6 away from the front end of the seat plate 1. Sub-frame 6, which is fixed to legrest frame 4, carries legrest frame 4 and because of the difference in the location of the pivot means 5 and pivot 7, relative to the front end of seat plate 1, legrest frame 4 moves arcuately upward carrying with it sub-frame 6. This is seen in FIG. 3.

A rail 9 is attached to sub-frame 6 via a bracket 9*a*. Rail 9 is mounted in a guide 10 (FIG. 4) the guide 10 being attached to frame 11 to facilitate the movement of frame 11 with respect to legrest frame 4 and sub-frame 6, as will be hereinafter described.

A first pair of pins 12 (FIGS. 2 and 3), carried by frame 11, anchor first ends respectively of springs 14; the other ends of which are anchored to pins 13 carried by legrest frame 4. Springs 14 are sized constructed, and positioned by being anchored to pins 12 and 13 so that there is always some spring tension between legrest frame 4 and frame 11 when frame 11 is positioned towards the front part of legrest frame 4. A roller 15 is carried at front or apex end of legrest frame 11.

A spring roller 16 (FIGS. 2 and 3) of conventional and suitable construction, is attached to one end of a tension belt 17 (FIG. 3) the other end of which is attached to one end of a cover sheet 18. Cover sheet 18 extends therefrom around roller 15 and has its other end secured to legrest frame 4. Sheet 18, tension belt 17 and spring roller 16 cooperate with each other and with frame 4 and roller 15 as hereinafter described.

A pivot point 20 (FIGS. 2 and 3), disposed and suitably connected beneath seat plate 1 proximate the front end thereof, serves to connect and provide a pivot for a first end of a first arm 21. The other end of first arm 21 is pivotally connected by a pin 24 to a first end of a second arm 23. Arm 23 is pivotally attached to sub-frame 6 at a pivot point 22. The other end of arm 23 is pivotally attached to a third arm 26 by a pin 27. Arm 26 is pivotally attached to frame 11 by a pivot point 25.

As hereinbefore described, suitable and conventional means are provided to connect air cylinder 8 to a suitable and appropriate supply of compressed air; and to control the supply and exhaust of compressed air to cylinder 8. When cylinder 8 is fully retracted into its housing legrest frame 4 is in its retracted position as shown in full lines in FIGS. 2 and 3. Legrest frame 4 is so disposed in its retracted position when the dental chair is in its upright position. When compressed air is supplied to cylinder 8 to extend cylinder 8, with respect to its housing, frame 11 is extended from legrest frame 4; and legrest frame 4 and frame 11 are moved to their extended positions as shown in dot dash lines in FIGS. 2 and 3.

Movement of frame 11 and legrest frame 4 between their extended and retracted positions is accomplished through arms 21, 23, and 26. As cylinder 8 receives compressed air and is moved from its housing it carries with it sub-frame 6 which, in turn, carries pivot pins 22 and second arms 23. Arms 23, due to their pivotal connection at 24 to first arms 21, pivot about pivot pins 22 such that pivot pins 27 (carried at the other ends of arms 23) effect pivoting and other movement of third arm 26 which, in turn, effect movement of frame 11 to move same from its retracted to its extended position. The respective size, positioning and operation of arms 21, 23, and 26 thus effects movement of frame 11 and legrest frame 4 from the retracted to the extended positions thereof. As frame 11 and legrest frame 4 so move, roller 15, mounted at the end of frame 11, also moves and by its cooperation with sheet 18 moves sheet 18 and pulls tension belt 17 against the action of spring roller 16.

Exhaustion of air from cylinder 8 reverses the movement of sub-frame 6, legrest frame 4 and of arms 21, 23 and 26 to effect movement of frame 11 and legrest frame 4 from their extended to their retracted positions. When frame 11 so moves spring action of the spring roller 16 rolls in tension belt 17 causing sheet 18 to shortened, in turn, causing legrest frame to pull inward and follow sub-frame 6.

Figure 5:
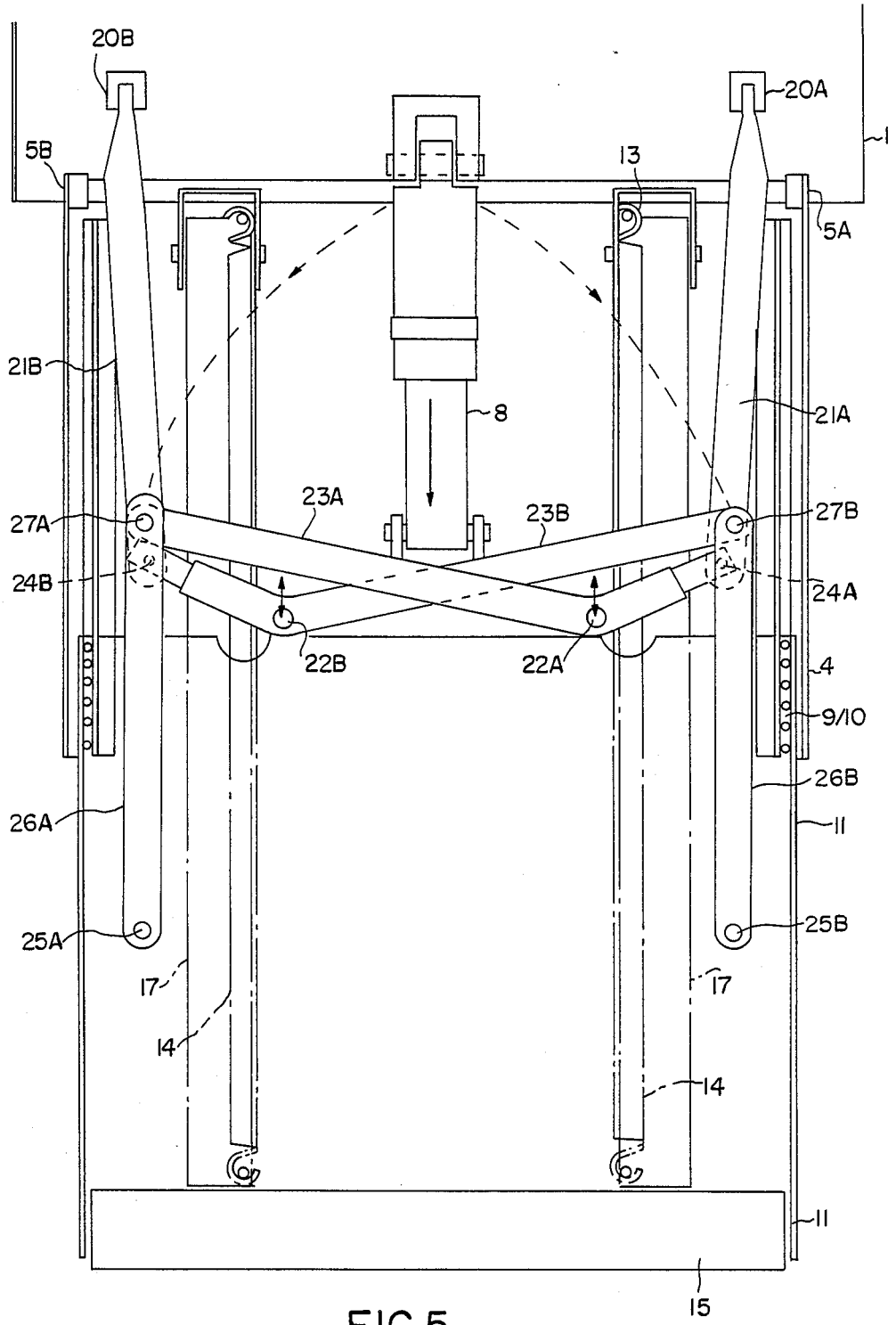
FIG. 5 is a bottom plan view of the section shown in FIG. 2, in the extended position.

FIG. 2 illustrates the extendable legrest in a closed or non-extended condition. FIG. 5 illustrates the extendable legrest in an extended condition. The linkage system is essentially a dual network mirror image linkage system. In FIG. 5, one part of the linkage system is illustrated by use of the letter A, the other part of the mirror image system is illustrated by use of the letter B. In FIG. 2 corresponding parts in the mirror image networks have the same call-out numbers.

One mirror image network includes arms 21A, 23A and 26A. Arm 21A is connected to the seat plate 1 at pivot 20A, the other end of arm 21A is connected to one end of arm 23A at pivot 24A. Arm 23A is connected at its other end to one end of arm 26A at pivot 27A. The other end of arm 26A is secured to frame 11 at point 25A. Arm 23A is bent or elbowed between its extremes but at a point closer to the pivot 24A than pivot 27A. At its elbow, arm 23A is connected to sub-frame 6 at point 22A which connection follows the movement of sub-frame 6 as sub-frame 6 thrusts and returns in response to the extending and receding of the cylinder 8.

When in a closed condition the air cylinder is in non-extended condition; sub-frame 6 is in non-extended condition; the arms 23A and 26A are jack-knifed at pivot 27A; legrest frame 4 assumes an essentially vertical position; and, frame 11 is recessed into a position between legrest frame 4 and sub-frame 6.

As sub-frame 6 moves forward by extension of the ram portion of air cylinder 8, the fixed elbow of arm 23A is moved forward at the connection point 22A. The short or advantage distance between point 22A and point 24A levers arm 23A so that the junction pivot 27A moves arcuately outward, urging arm 26A forward which drives frame 11 via its connection at 25A out of its recessed position, the frame 11 moving slowly at first as the pivot 27A moves arcuately from its central position and then more rapdily as sub-frame 6 approaches the extremes of its forward travel and as the points 27A and 25A move into alignment with the direction of forward movement of sub-frame 6 and frame 11.

As frame 11 is driven forward by its connection to arm 26A at point 25A, the roller 15, connected to the end of frame 11 is advanced, applying a pulling force on sheet 18 against the spring roller 16 and tension belt 17.

It should be noted that the distance between pivot point 20 and pivot point 22 becomes longer as sub-frame 6 is moved to its extended position by cylinder 8. As this occurs the pivoting movement of arm 23 (carried and pivoting about pivot point 22) and its pivotal connection to arm 26 will effect an exaggerated movement of frame 11 to its forward motion. Pivot points 20 and 5 are selected to be almost horizontally disposed one with respect to the other when legrest frame 4 is in its retracted positions. Because of this, the distance between pivot point 20 and 22 will hardly change in the initial stages of movement of legrest 4 towards its extended position. However, the distance between pivot points 20 and 22 increases drastically as legrest frame 4 moves into its extended position. Thus, it can be seen that the construction and relationship of the linkage mechanism 21, 23, 26, and their respective connection to each other and to frames 4 and 11, is such that any arm 23 starts slow but ends up as an accelerated motion. This construction is such that the extension of frame 11 starts out slowly and speeds up in the end and in the same manner but opposite to the motion of frame 11, moves the apex of frame 4 when it reclines in or retracts. Because of this even when the distance from the floor to the apex (roller 15 end) of frame 4, is at a bare minimum (that is when the chair is in its upright position and frame 4 is substantially perpendicular to the floor) roller 15 and sheet 18 will not hit the floor.

Thus, it can be seen that the dental chair can be used as a stand-up dentistry chair, with its backrest 3 and legrest frame 4 upright, to allow the patient to sit as the dentist examines standing up. Alternatively, the desired dental chair can be used in a reclining position where the dentist sits while the patient is in a reclined position.

As various possible embodiments might be made of the invention, and as various changes might be made in the embodiments above set forth, it is to be understood that all matter herein described and shown in the accompanying drawings is to be interpreted as illustrative and not in a limiting sense. Thus, it will be understood by those skilled in the art that although preferred and alternative embodiments have been shown and described in accordance with the Patents Statutes, the invention is not limited thereto or thereby, since the embodiments of the invention particularly disclosed and described herein above ar presented merely as an example of the invention. Other embodiments, forms, and modifications of the invention, coming within the proper scope and spirit of the appended claims, will of course readily suggest themselves to those skilled in the art. Thus, while there has been described what is at present considered to be the preferred embodiments of the invention, it will be obvious to those skilled in the art that various changes and modifications may be made therein, without departing from the invention, and it is, therefore, aimed in the appended claims to cover all such changes and modifications as fall within the true spirit and scope of the invention, and it is understood that, although I have shown the preferred form of my invention, that various modifications may be made in the details thereof, without departing from the spirit as comprehended by the following claims.

What is claimed is

1. A legrest for a positionable chair having a seat and a legrest extending therefrom, said legrest comprising:

(a) legrest frame means pivotally attached to said seat of said chair proximate a front end thereof;

(b) sub-frame means fixedly coupled to said legrest frame means;

(c) extendable cylinder means pivotally attached at an end thereof to said seat of said chair proximate said front end thereof but more removed from said front end than the pivotal attachment of said legrest frame means to said chair, the other end of said extendable cylinder means attached to said sub-frame means so that when said extendable cylinder means is extended, said sub-frame is moved along with the extendable end of said extendable cylinder means and said legrest frame is moved arcuately about its pivotal attachment to said seat of said chair;

(d) internal frame means positioned between said legrest frame means and said sub-frame means movably connected to said sub-frame means by a rail and guide means and extendable out of its position between said legrest means and said sub-frame means in response to action of a linkage means said linkage means comprising spring means having a first end connected to said legrest means and a second end connected to said internal frame means for urging said internal frame means into a home position, a plurality of pairs of linkage arms forming a dual network linkage system each network pivotally interconnecting said internal frame means and said sub-frame means to each other with one end of each said network connected to said seat of said chair and the other end of each said network connected to said internal frame means, each said network connected to said sub-frame means at a pivot point interum said one end and said other end of the respective network so as to move said internal frame means relative to its position between said legrest and said sub-frame means when said extendable cylinder means moves said sub-frame means.

2. A legrest for a positionable chair as in claim 1 and in which the arms of each said network of said linkage system are interconnected and each network is connected to said sub-frame at an interum between the extremes of each network such that when said sub-frame is moved by said extendable cylinder means said internal frame means moves from its home position to an extended position, moving slowly at first and then more rapidly as said internal frame means approaches a fully extended position.

3. A legrest for a positionable chair as in claim 1 and in which the position of pivotal attachment of said legrest frame means and the position of attachment of said sub-frame means is such that when said sub-frame means is moved by said extendable cylinder means said legrest frame means moves arcuately, pivoting about its pivotal attachment to said seat of said chair, said legrest frame means carrying with it said sub-frame means and said internal frame means.

4. A legrest for a positionable chair as in claim 1 wherein said internal frame means includes a roller means carried at an extremity of said internal frame means.

5. A legrest for a positionable chair as in claim 4 and in which said legrest further includes spring roller means and a sheet means, said sheet means extending over a portion of said roller means and coupled to said spring roller means, said spring roller means for exerting a tension on said sheet means from one end there of so that as said internal frame means moves relative to its said home position portions on said sheet means pass over said roller means.

6. A legrest for a positionable chair as in claim 1 and in which each network of said dual network linkage system includes a first arm having one end coupled to said seat of said chair and the other end connected to one end of second arm, the other end of said second arm connected to one end of a third arm, the other end of said third arm connected to said internal frame means and said second arm connected at a point interum said one end and said other end to said sub-frame means, said interum point being closer to said one end of said second arm than said other end of said second arm.

* * * * *